US007248129B2

(12) United States Patent
Hubert

(10) Patent No.: US 7,248,129 B2
(45) Date of Patent: Jul. 24, 2007

(54) MICROSTRIP DIRECTIONAL COUPLER

(75) Inventor: John Hubert, Clermont, FL (US)

(73) Assignee: Xytrans, Inc., Orlando, FL (US)

( * ) Notice: Subject to any disclaimer, the term of this patent is extended or adjusted under 35 U.S.C. 154(b) by 36 days.

(21) Appl. No.: 11/132,125

(22) Filed: May 18, 2005

(65) Prior Publication Data

US 2005/0258917 A1 Nov. 24, 2005

Related U.S. Application Data

(60) Provisional application No. 60/572,640, filed on May 19, 2004.

(51) Int. Cl.
*H01P 5/00* (2006.01)
*H01P 5/18* (2006.01)

(52) U.S. Cl. ..... 333/109; 333/112

(58) Field of Classification Search ..... 333/109, 333/110, 111, 112, 113, 116
See application file for complete search history.

(56) References Cited

U.S. PATENT DOCUMENTS

| | | | | |
|---|---|---|---|---|
| 3,868,594 | A * | 2/1975 | Cornwell et al. | 331/99 |
| 4,211,911 | A | 7/1980 | Dehn | 219/746 |
| 4,224,584 | A | 9/1980 | Houdart | 333/116 |
| 4,305,043 | A | 12/1981 | Ho et al. | 330/53 |
| 4,316,159 | A | 2/1982 | Ho | 333/104 |
| 4,677,399 | A * | 6/1987 | Le Dain et al. | 333/116 |
| 5,159,298 | A | 10/1992 | Dydyk | 333/112 |
| 5,281,929 | A | 1/1994 | Willems | 333/116 |
| 5,424,694 | A * | 6/1995 | Maloratsky et al. | 333/116 |
| 5,625,328 | A * | 4/1997 | Coleman, Jr. | 333/116 |
| 6,359,534 | B2 | 3/2002 | Hunter | 333/219.1 |
| 6,498,551 | B1 | 12/2002 | Ammar et al. | 333/247 |
| 6,627,992 | B2 | 9/2003 | Ammar | 257/728 |
| 6,759,743 | B2 | 7/2004 | Ammar | 257/728 |
| 6,788,171 | B2 | 9/2004 | Ammar et al. | 333/247 |
| 6,967,543 | B2 | 11/2005 | Ammar | 333/125 |
| 7,050,765 | B2 | 5/2006 | Ammar et al. | 455/90.3 |
| 2003/0132815 | A1 | 7/2003 | Lohr | 333/109 |

OTHER PUBLICATIONS

M. Morgan, S. Weinreb, "Octave-Bandwidth High-Directivity Microstrip Codirectional Couplers," IEEE International Microwave Symposium, Jun. 2003.

D. Brady, "The Design, Fabrication and Measurement of Microstrip Filter and Coupler Circuits," High Frequency Electronics, Jul. 2002 vol. 1, No. 1.

* cited by examiner

*Primary Examiner*—Dean Takaoka
(74) *Attorney, Agent, or Firm*—Allen, Dyer, Doppelt, Milbrath & Gilchrist, P.A.

(57) ABSTRACT

A microwave directional coupler includes a microstrip conductor formed on a dielectric substrate and forming a main transmission line having in and out ports that receive signals to be coupled. A substantially U-shaped microstrip conductor is formed over the dielectric substrate adjacent to the main transmission line and forms a secondary transmission line having a coupling section and coupler port. A load resistor is formed within the secondary transmission line, and the coupling section is less than a quarter wavelength of a center frequency.

15 Claims, 7 Drawing Sheets

MICROSTRIP DIRECTIONAL COUPLER

RELATED APPLICATION

This application is based upon prior filed copending provisional application Ser. No. 60/572,640 filed May 19, 2004.

FIELD OF THE INVENTION

This invention relates to the field of directional couplers, and more particularly, this invention relates to microstrip directional couplers operative at microwave frequencies.

BACKGROUND OF THE INVENTION

Directional couplers often are formed as waveguide, stripline, or microstrip directional couplers. Typical waveguide directional couplers are used primarily to sample power for measurements. For example, two waveguides could be located side-by-side, one above the other, parallel, or crossing each other. Holes can be drilled in a common wall to permit coupling between the waveguides.

A stripline or microstrip coupler, on the other hand, usually has a main transmission line in close proximity to a secondary transmission line. In some designs, quarter wavelength coupling sections are added to either side of a center section to increase bandwidth and reduce ripple. These quarter wavelength sections are less tightly coupled than the center section, and are equally disposed about the center section. For some microstrip applications, the velocity of propagation is different for even and odd modes, and to compensate for this difference, sometimes a capacitor is added to increase the localized capacitance and improve the directivity of the coupler. In these types of systems, when two coupler lines are in close proximity and the phase of energy is the same, an even mode symmetry of fields is accomplished. When the fields are 180 degrees out of phase, however, there is an odd mode symmetry.

High-directivity couplers are desirable for a wide variety of applications, including terrestrial transceivers or subsystems, test equipment and laboratory components. In the case of terrestrial transmitters equipped with a power monitor, it is essential to reduce the effects of load variations on the accuracy of the sampled output power. Accurate power monitor readings can be achieved by using either a high-directivity coupler, with greater than 15 dB directivity, such as shown in the schematic circuit diagram of FIG. 1, or a standard coupler cascaded with a circulator having one port terminated in a load, such as shown in the schematic circuit diagram of FIG. 2. FIG. 1 shows an amplifier 20 connected to a higher directivity coupler 22, which includes a primary transmission line 24 having in and out ports 26, 28, and a secondary transmission line 30 with a monitor port 32, coupling section 34 and load 36 connected to ground 38.

FIG. 2 shows a similar circuit, yet having the out port 28 connected to a circulator 40, and, in turn, connected to a load 42, connected to ground 45. The circulator 40 has an out port 44.

Cost and size quickly become key factors in choosing which system configuration to use. Different couplers have been used in prior art millimeter wave and other microwave coupling systems. For example, some waveguide circulators, such as manufactured by Flann Microwave, can be used at millimeter wave frequencies and integrated into Multipoint Video Distribution System/Local Multipoint Distribution Service (MVDS/LMDS) base stations or similar radio stations. One transmitter can feed a number of antenna arrays in point-to-multipoint transmitter systems. A microstrip circulator with the required ferrite puck mounted on top, such as produced by Renaissance Electronics Corporation, has also been used. A single junction microstrip circulator can include a stack-up of different parts, including a ground plane that could be metallized on the ferrite, and a ferrite disk with a conductive metal circuit having arms at 120 degrees relative to each other or at other angles as chosen by those skilled in the art. A spacer could be used to keep microwave fields out of the magnet and also supply a DC magnetic field. The phase shift between ports in the circulation direction could be 120 degrees using 120 degree spaced arms, while a phase shift in the opposite direction could be 60 degrees. For example, energy could be transmitted from port 1 to port 2 and shifted 120 degrees while energy from port 1 to port 3 could be shifted 60 degrees. Energy from ports 2-3 could be shifted 60 degrees. As another example, energy going either direction could be in phase at port 2 and adds together, while energy at port 3 is out of phase and cancels because no energy is transmitted to the port. Adding a termination at port 3 could convert the circulator to an isolator.

A high-directivity coupler is preferred over a standard coupler cascaded with a circulator because of its lower material cost, decreased assembly cost, smaller size, reduced complexity and temperature stability. Any directional coupler design is directed to how much directivity can be achieved from a given coupler. Directivity is therefore a qualitative benchmark by which couplers are compared.

High-directivity couplers can be fabricated in several technologies including waveguide, stripline or microstrip. Once again, however, cost and size are key factors. One type of standard high-directivity waveguide coupler, such as manufactured by Flann Microwave, is a three port design, and can include a low reflection termination built into the fourth arm. Standard coupling valves can be between about 10 and 20 dB.

A reduced-length high-directivity waveguide coupler, such as manufactured by Advanced Technical Materials, Inc. of Patchoque, N.Y., can be formed as a short length, high-directivity device, allowing a short insertion length and high-directivity. It can replace a cross-guide coupler where directivity is marginal and a short length is required. A typical, nominal coupling variation is about +/−0.75 dB, and a flatness is achieved of about +/−0.75 dB by using carefully controlled machining patterns. It can include a coupling of 30, 40 and 50 dB, and a frequency sensitivity and coupling accuracy of +/−0.5 dB. The directivity is about 25 MIN and 30 typical. The Voltage Standing Wave Ratio (VSWR) for the primary arm is about 1.05 and that for the secondary arm is about 1.25. These types of waveguide components are not preferred in some applications because of their high cost and large size.

Many Radio Frequency (RF) boards are designed in a microstrip (M/S) environment to facilitate the use of Monolithic Microwave Integrated Circuits (MMICs), any available Computer Aided Design (CAD) simulator models, and conventional test equipment. To integrate a stripline coupler into a microstrip environment requires an additional dielectric layer, an extra ground plane, and typically additional vias. Stripline couplers typically have not been preferred because of their increased complexity, substantial assembly time in manufacture, added material costs compared to other commercially available couplers, and increased labor costs associated with their manufacture and assembly.

Microstrip coupler designs have typically been more popular in use by circuit designers. High-directivity couplers that are compact, however, are difficult to design in a microstrip environment. A traditional microstrip coupler approach, for example, shown in the schematic circuit diagram of FIG. 3 and the fragmentary plan view of FIG. 4, has a quarter-wave coupling section with one port terminated into a load. FIG. 3 shows a linear, main transmission line 50 having in and out ports 52, 54, and secondary transmission line 56 that is U-shaped and includes a coupled port 58 on one leg and load 60 on the other leg and connected to ground 61. The coupling section 62 is shown by the two transmission line sections that are adjacent and parallel to each other. FIG. 4 shows a plan view of a microstrip example with elements in this microstrip example similar to those shown in the schematic circuit diagram of FIG. 3 having the same reference numerals. Unfortunately, this approach has often yielded relatively large couplers with poor directivity.

Some attempts to develop high-directivity microstrip couplers have been published, for example, in D. Brady, "The Design, Fabrication and Measurement of Microstrip Filter and Coupler Circuits," *High Frequency Electronics*, July, 2002 volume 1, number 1; and M. Morgan, S. Weinreb, "Octave-Bandwidth High-Directivity Microstrip Co-Directional Couplers," *IEEE International Microwave Symposium*, June 2003.

For example, a Schiffman, reduced-size directional microstrip coupler is shown in FIG. 5 at 70 and is reported to have some improvement in directivity. This coupler 70 includes a saw-tooth inner section 72 located between the main transmission line 74 and secondary transmission line 76. This coupler, however, is large and requires fine geometries. A backward wave microstrip coupler is shown in FIG. 6 at 80. It includes curved and adjacent transmission lines 82, 84. This coupler is also reported to have some improvement in directivity, but it is also extremely large.

SUMMARY OF THE INVENTION

In accordance with embodiments of the present invention, a compact, high-directivity microstrip coupler used for microwave frequencies has a coupling section that is less than a quarter wavelength, which aids in limiting mismatch of the even and odd modes. A load resistor and associated match are adjusted to achieve a desired directivity over a given frequency band. High directivity of greater than 15 dB can be achieved in one nonlimiting embodiment.

In accordance with an example of the present invention, a microwave directional coupler includes a dielectric substrate and a microstrip conductor over the dielectric substrate and forming a main transmission line having in and out ports that receive signals to be coupled. A substantially U-shaped microstrip conductor is formed over the dielectric substrate adjacent to the main transmission line and forms a secondary transmission line having a coupling section and coupler port. A load resistor is formed within the secondary transmission line. The coupling section is typically less than a quarter wavelength of a center frequency.

In another aspect, a microstrip conductor forming the main transmission line is linear and has in and out ports opposite each other. In another embodiment, the substantially U-shaped microstrip conductor formed over the dielectric substrate includes a coupling section formed from a linear segment substantially parallel and adjacent to the main transmission line, and first and second coupling segments extending from the linear segment. The coupling section is typically less than a quarter wavelength from a center frequency. A first leg extends from the first coupling segment to the coupler port and a second leg extends from the second coupling segment and has a load resistor formed therein and secured to ground.

The microstrip conductor forming the main transmission line in one aspect is linear and has in and out ports opposing each other. The second leg can include a U-shaped segment disposed therein. In another aspect the second leg can be substantially L-configured, substantially linear configured and aligned with the second coupling segment, or substantially serpentine configured. The first leg can also extend outward at an angle from the second leg and this angle between the first leg and first coupling segment can be between about ten to about 30 degrees measuring from the interior of the U-shaped microstrip conductor. In another aspect, the first leg can include a large rectangular segment that aids in forming a match that is adjusted to the load resistor to aid in forming a desired directivity. The range of the center operating frequency can be from about below 15 to above about 23 GHz in one nonlimiting example.

BRIEF DESCRIPTION OF THE DRAWINGS

Other objects, features and advantages of the present invention will become apparent from the detailed description of the invention, which follows when considered in light of the accompanying drawings in which.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

A compact, high-directivity microstrip coupler usable at microwave frequencies in accordance with an embodiment of the invention is set forth. In one aspect, it can achieve a high-directivity of greater than 15 dB and enable high-performance in a microstrip environment. It can have a short coupling section and a compact size, and matched even and odd modes. This type of microstrip directional coupler does not require fine geometries. It is compatible with extremely low frequencies because of its small size, but also compatible with extremely high frequencies. It is also compatible with low-cost thick film fabrication, and more tolerant to process variations.

Because directivity is an important coupler characteristic in many applications, some designers strive for high directivity. This becomes very challenging, and not easily achieved, when loose coupling and small size are desired. A compact, high-directivity, microstrip coupler usable at microwave frequencies provides a solution for this problem.

Figure 1:
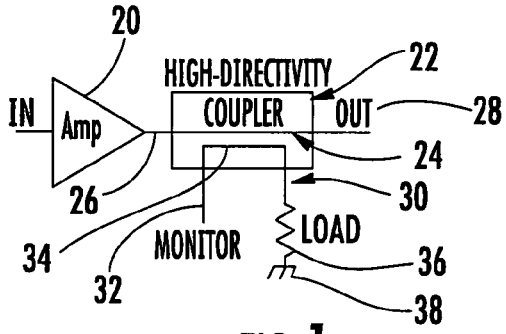
FIG. 1 (PRIOR ART)
FIG. 1 is a schematic circuit diagram of an example of a high directivity coupler.
Figure 2:
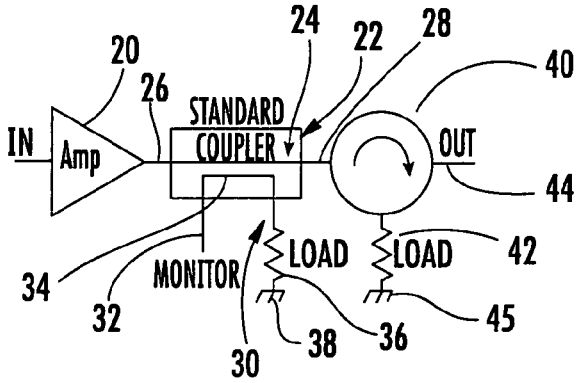
FIG. 2 (PRIOR ART)
FIG. 2 is a schematic circuit diagram of an example of a conventional directional coupler and circulator.
Figure 3:
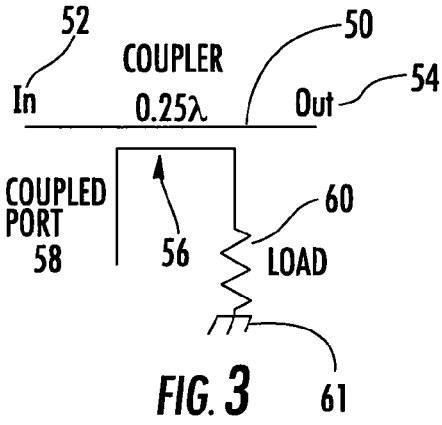
FIG. 3 (PRIOR ART)
FIG. 3 is a schematic circuit diagram of an example of a conventional microstrip coupler.
Figure 4:
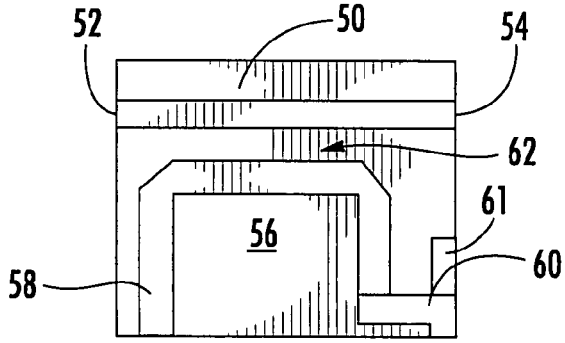
FIG. 4 (PRIOR ART)
FIG. 4 is a top plan view of an example of a conventional microstrip coupler such as shown in FIG. 3.
Figure 5:
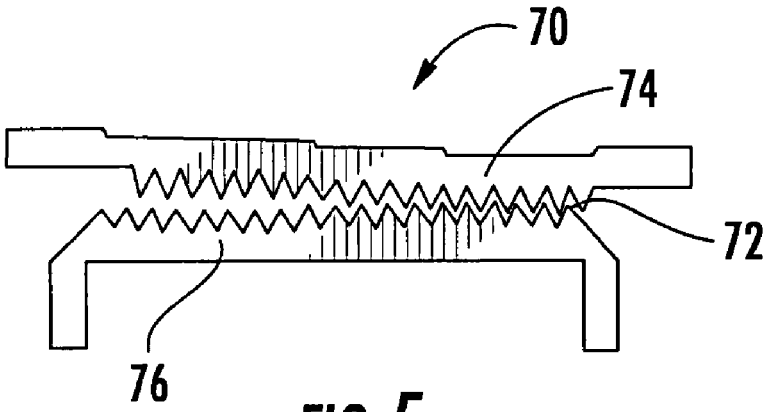
FIG. 5 (PRIOR ART)
FIG. 5 is a top plan view of a prior art Schiffman directional microstrip coupler.
Figure 6:
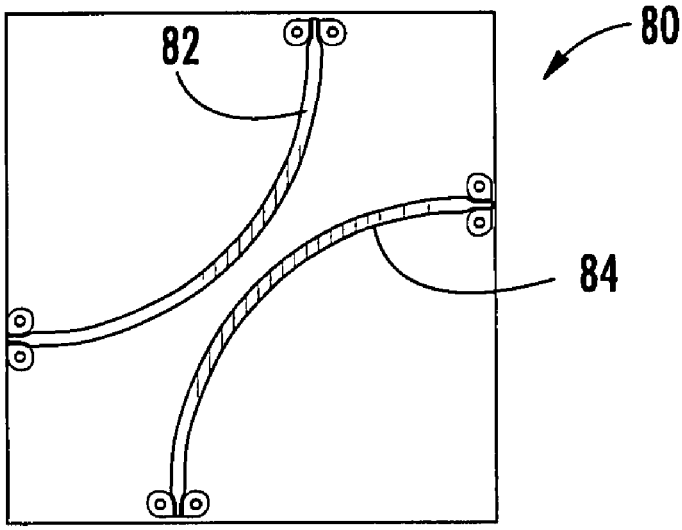
FIG. 6 (PRIOR ART)
FIG. 6 is a top plan view of a prior art backward wave microstrip coupler.
Figure 7:
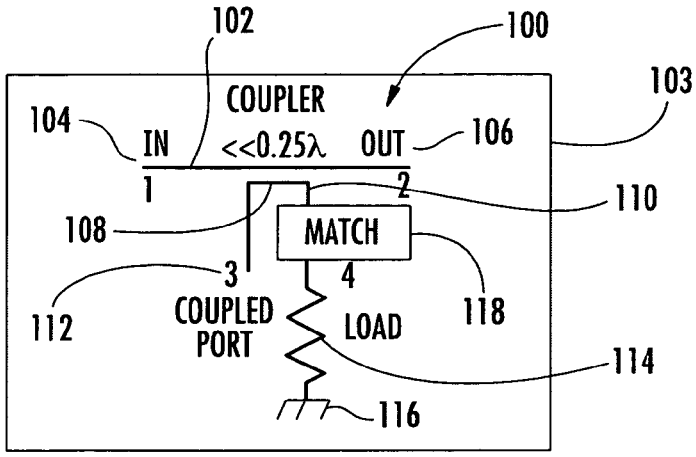
FIG. 7 is a schematic circuit diagram of a microstrip, microwave directional coupler in accordance with an example of the present invention.

A schematic circuit diagram of microstrip coupler in accordance with an aspect of the present invention is shown in FIG. 7. The coupling section is typically less than a quarter wavelength, which allows "loose" coupling and limits the mismatch of even and odd modes. Any load resistor and associated match are adjusted to achieve a desired directivity over a given frequency band. The schematic circuit diagram of FIG. 7 shows a microstrip coupler 100 that includes a microstrip conductor 102 formed over a dielectric substrate 103 and forming a main transmission line having in and out ports 104, 106, that receive signals to be coupled. A substantially U-shaped microstrip conductor 108 is formed over the dielectric substrate 103 adjacent the main transmission line 102 and forms a secondary transmission line having a coupling section 110 and coupled port 112. A load resistor 114 is formed within the secondary transmission line, and the coupling section is typically less than a quarter wavelength of a center frequency. The load resistor 114 is connected to ground 116. A matching circuit 118 portion is adjusted with the load resistor 114 to aid in forming a desired directivity.

Figure 8:
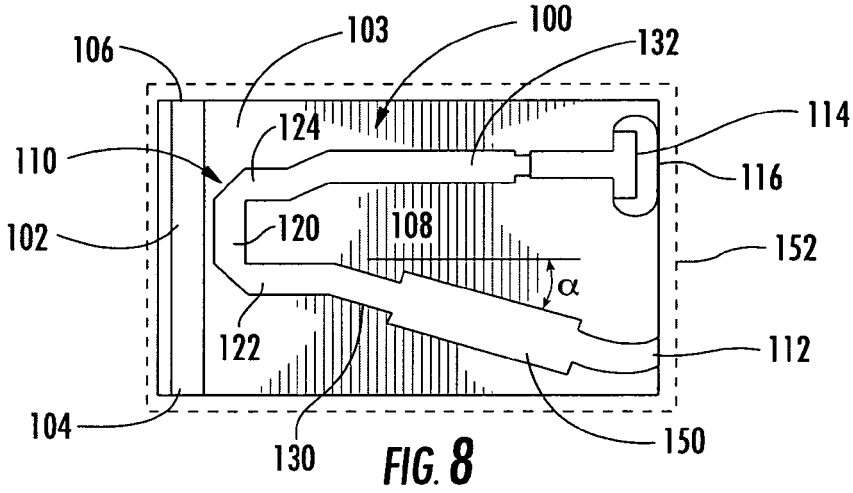
FIG. 8 is a top plan view of the microstrip, microwave directional coupler in accordance with an example of the present invention such as shown by the schematic circuit diagram of FIG. 7.

A top plan view of the coupler 100 in microstrip form is shown in FIG. 8 and elements in common with the schematic circuit diagram elements are given the same reference numerals.

As illustrated in FIG. 8, the coupling section 110 formed from a linear segment 120 that is substantially parallel and adjacent to the main transmission line. First and second coupling segments 122, 124 extend from the linear segment 120. A first leg 130 extends from the first coupling segment 122 to the coupled port and a second leg 132 extends from the second coupling segment 124 and has the load resistor 114 formed therein and secured to the ground 116. As illustrated, the main transmission line is preferably linear with opposing ports and the linear segment is spaced close to and parallel to the main transmission line. The first leg 130 extends outward at an angle from the second leg 132. This angle between the first leg and first coupling segment 122 is shown by the angle a in FIG. 8, and in one nonlimiting example, is between about ten to about thirty degrees measuring from an interior of the U-shaped microstrip conductor.

An enlarged rectangular segment 150 is positioned on the first leg 130 and aids in forming a match that is adjusted to the load resistor 114 to aid in imparting a desired directivity. As illustrated, in this nonlimiting example, the first and second coupling segments 122, 124 are positioned substantially 90 degrees to the linear segment 120, which is parallel to the main transmission line. These angles can vary, of course, and are nonlimiting examples only. The dielectric 103 will also typically be secured over a ground plane 152 as indicated by the dashed line in FIG. 8.

Figure 9:
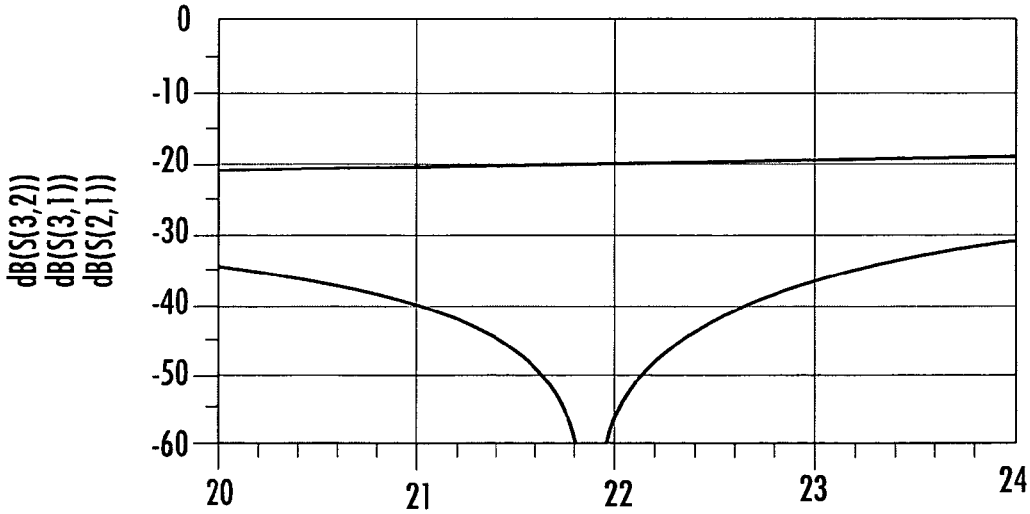
FIG. 9 is a graph showing a simulation of the microstrip, microwave directional coupler of the type such as shown in FIG. 8 in accordance with an example of the present invention.

Simulation results are shown in FIG. 9, and show the decibel range on the Y, vertical axis and the frequency, on the X, horizontal axis.

FIGS. 10 through 13 show other embodiments of the microstrip coupler 100 in which the first and second legs are formed in different configurations to be used in particular transmitter or receiver applications at different microwave frequencies. The main transmission line in the different embodiments shown in FIGS. 10 through 13 are also configured differently from each other but are still substantially configured as a linear transmission line as illustrated.

Figure 10:
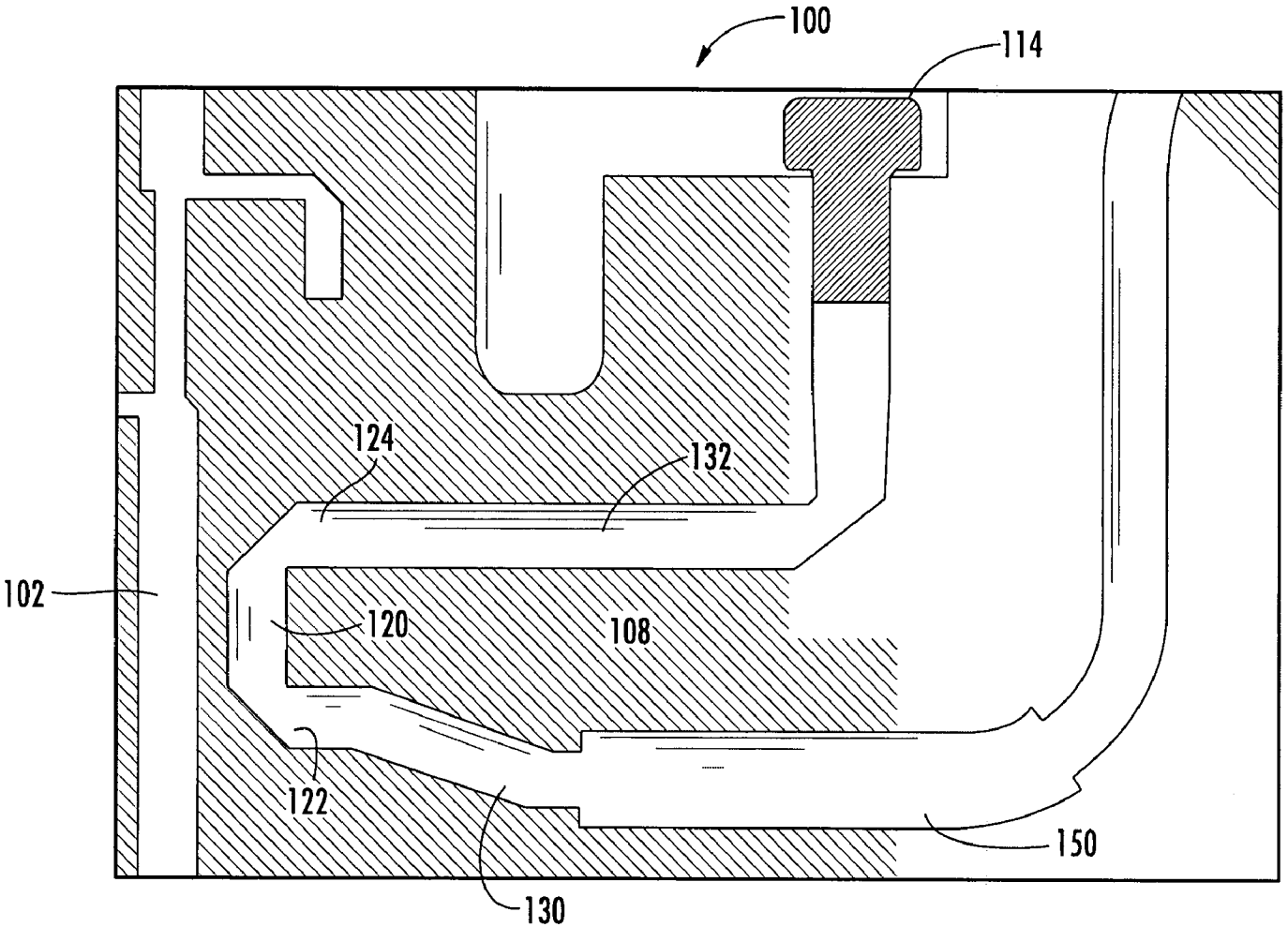
FIG. 10 is a top plan view of the microstrip, microwave directional coupler in accordance with another example of the present invention and showing a near 15 GHz transmitter output.

FIG. 10 shows a near 15 GHz transmitter output microstrip coupler in which the second leg is substantially L-configured. The first leg has an outwardly extending portion from the first coupler segment until the large rectangular segment is substantially parallel to the second coupling segment and the upper portion of the L-configured second leg.

Figure 11:
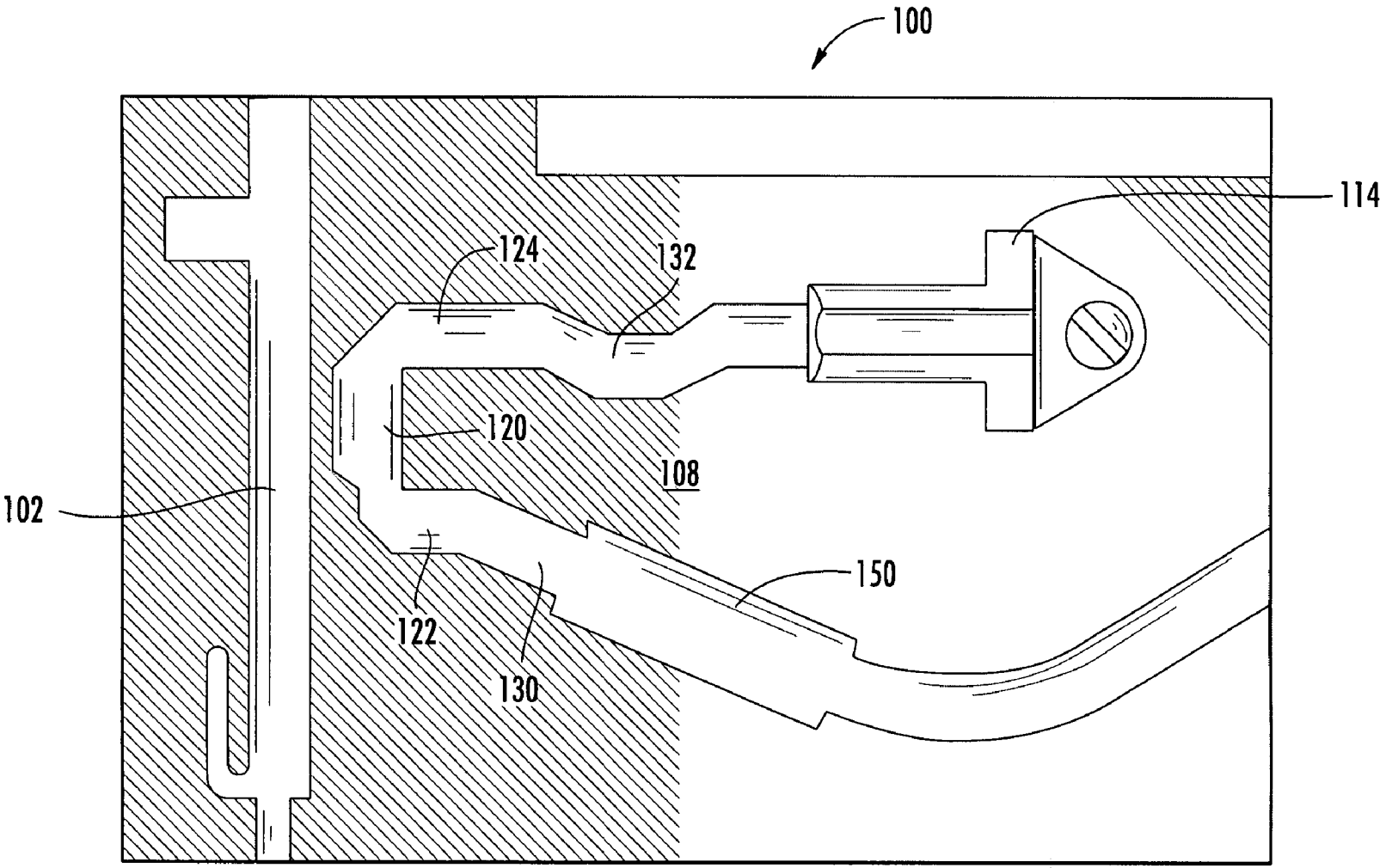
FIG. 11 is a top plan view of the microstrip, microwave directional coupler in accordance with another example of the present invention and showing a near 23 GHz transmitter output.

FIG. 11 shows a near 23 GHz transmitter output microstrip coupler in which the second leg is substantially serpentine configured and the first leg extends at an angle outward and includes the enlarged rectangular segment.

Figure 12:
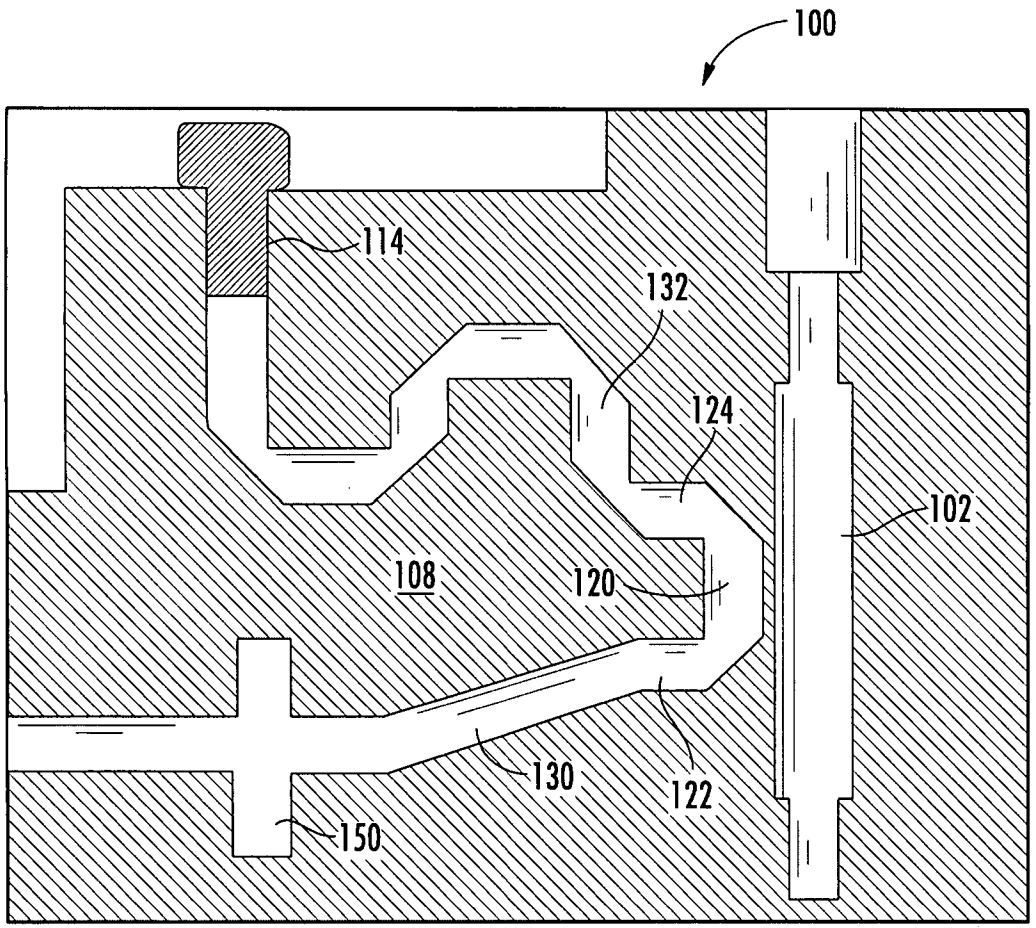
FIG. 12 is a top plan view of the microstrip, microwave directional coupler in accordance with another example of the present invention and showing a near 15 GHz receiver output.

FIG. 12 shows a near 15 GHz receiver output microstrip coupler in which the second leg includes a U-shaped segment disposed therein and the first leg extends outward and a rectangular segment is formed as a cross-member.

Figure 13:
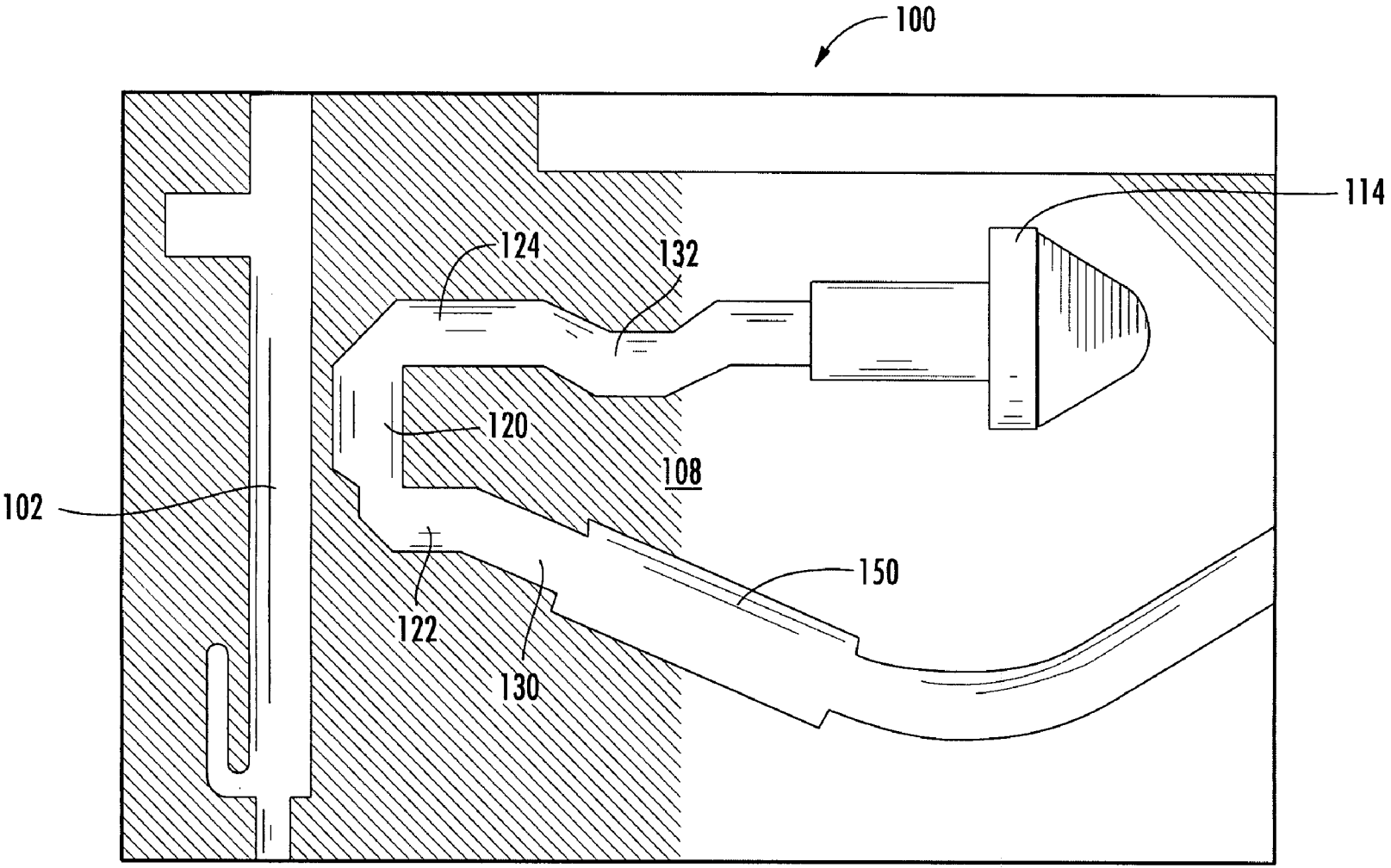
FIG. 13 is a top plan view of the microstrip, microwave directional coupler in accordance with another example of the present invention and showing a near 18 GHz receiver output.

FIG. 13 is a near 18 GHz receiver output microstrip coupler in which the second leg is substantially serpentine configured.

These examples show a range of a center operating frequency from below about 15 to above about 23 GHz.

It should be understood, that these microstrip, microwave directional couplers are examples that can be used in many applications, including millimeter wave outdoor units and millimeter wave transceiver modules, including synchronous digital hierarchy (SDH) outdoor units and pleisiochronous digital hierarchy (PDH) outdoor units, as well as SDH or PDH transceiver modules.

They can be used with millimeter waves (MMW) links that use the outdoor unit and antenna such as attached to a pole in nonlimiting examples for both point-to-point and point-to-multipoint systems.

Examples of such products and devices that the couplers as described can be used, include those products and devices disclosed and set forth in commonly assigned U.S. Pat. Nos. 6,498,551; 6,627,992; 6,759,743; 6,788,171; and commonly assigned published patent application Nos. 2004/0140863 and 0203528, the disclosures which are hereby incorporated by reference in their entirety.

These devices disclose different structures including thick film substrates that can be used for the coupler and different layered structures and via constructions and different back planes.

Many modifications and other embodiments of the invention will come to the mind of one skilled in the art having the benefit of the teachings presented in the foregoing descriptions and the associated drawings. Therefore, it is to be understood that the invention is not to be limited to the specific embodiments disclosed, and that the modifications and embodiments are intended to be included within the scope of the dependent claims.

The invention claimed is:

1. A microwave directional coupler comprising:

a dielectric substrate;

a microstrip conductor formed over the dielectric substrate and forming a main transmission line having in and out ports that receive signals to be coupled; and a substantially U-shaped microstrip conductor formed over the dielectric substrate adjacent the main transmission line and forming a secondary transmission line having a coupling section and coupled port, and further comprising a load resistor formed within the secondary transmission line, wherein the coupling section is less than a quarter wavelength of a center frequency and the range of the center operating frequency is below about 15 to above about 23 GHz.

2. A microwave directional coupler according to claim 1 wherein said micro strip conductor forming the main transmission line is linear and has in and out ports opposite each other.

3. A microwave directional coupler according to claim 1 wherein said U-shaped microstrip conductor forming the secondary transmission line comprises a linear segment parallel and adjacent to the main transmission line, and first and second coupling segments extending from the linear segment, and first and second legs extending from the coupling segments away from the main transmission line, the first leg extending to the coupled port and the second leg extending to the load resistor.

4. A microwave directional coupler according to claim 3 wherein said second leg includes a U-shaped segment disposed therein.

5. A microwave directional coupler according to claim 3 wherein said first leg includes an enlarged rectangular segment to aid in forming a match that is adjusted with the load resistor to aid in forming a desired directivity.

6. A microwave directional coupler according to claim 1 and further comprising a ground connection connected to the load resistor.

7. A microwave directional coupler comprising:

a dielectric substrate;

a microstrip conductor formed over the dielectric substrate and forming a main transmission line having in and out ports that receive signals to be coupled; and a substantially U-shaped microstrip conductor formed over the dielectric substrate adjacent the main transmission line and forming a secondary transmission line having a coupling section and coupled port, and further comprising a load resistor formed within the secondary transmission line, wherein the coupling section is less than a quarter wavelength of a center frequency, wherein said U-shaped microstrip conductor forming the secondary transmission line comprises a linear segment parallel and adjacent to the main transmission line, and first and second coupling segments extending from the linear segment, and first and second legs extending from the coupling segments away from the main transmission line, the first leg extending to the coupled port and the second leg extending to the load resistor, and the first leg includes an enlarged rectangular segment to aid in forming a match that is adjusted with the load resistor to aid in forming a desired directivity, wherein said range of the center operating frequency is below about 15 to above about 23 GHz.

8. A microwave directional coupler comprising:

a dielectric substrate;

a microstrip conductor formed over the dielectric substrate and forming a main transmission line having in and out ports that receive signals to be coupled; and a substantially U-shaped microstrip conductor formed over the dielectric substrate adjacent the main transmission line and forming a secondary transmission line and having a coupled port, said secondary transmission line further comprising a coupling section formed from a linear segment substantially parallel and adjacent to the main transmission line and first and second coupling segments extending from the linear segment, wherein the coupling section is less than a quarter wavelength of a center frequency, and a first leg extending from the first coupling segment to the coupled port and a second leg extending from the second coupling segment and having a load resistor formed therein and secured to ground and the first leg extends outward at an angle from the second leg wherein the angle between the first leg and first coupling segment is between about 10 to about 30 degrees measuring from an interior of the U-shaped microstrip conductor.

9. A microwave directional coupler according to claim 8 wherein said microstrip conductor forming the main transmission line is linear and has in and out ports opposite each other.

10. A microwave directional coupler according to claim 8 wherein said second leg includes a U-shaped segment disposed therein.

11. A microwave directional coupler according to claim 8 wherein said second leg is substantially L-configured.

12. A microwave directional coupler according to claim 8 wherein said second leg is substantially linear and aligned with the second coupling segment.

13. A microwave directional coupler according to claim 8 wherein said second leg is substantially serpentine configured.

14. A microwave directional coupler according to claim 8 wherein said first leg includes an enlarged rectangular segment to aid in forming a match that is adjusted to the load resistor to aid in imparting a desired directivity.

15. A microwave directional coupler according to claim 8 wherein said range of the center operating frequency is below about 15 to above about 23 GHz.

* * * * *

UNITED STATES PATENT AND TRADEMARK OFFICE

CERTIFICATE OF CORRECTION

PATENT NO. : 7,248,129 B2
APPLICATION NO. : 11/132125
DATED : July 24, 2007
INVENTOR(S) : John Hubert It is certified that error appears in the above-identified patent and that said Letters Patent is hereby corrected as shown below:

Column 6, line 3: Delete:
"122 is shown by the angle a in FIG. 8,"

Substitute:
-- 122 is shown by the angle α in FIG. 8,--

Signed and Sealed this

Ninth Day of October, 2007

JON W. DUDAS
*Director of the United States Patent and Trademark Office*